US010451052B2

(12) United States Patent
Saukko et al.

(10) Patent No.: US 10,451,052 B2
(45) Date of Patent: Oct. 22, 2019

(54) LOAD/UNLOAD CONTROL METHOD FOR COMPRESSOR SYSTEM

(71) Applicant: ABB Schweiz AG, Baden (CH)

(72) Inventors: Juha Saukko, Helsinki (FI); Markku Lyyjynen, Espoo (FI); Jukka Tolvanen, Helsinki (FI)

(73) Assignee: ABB Schweiz AG, Baden (CH)

( * ) Notice: Subject to any disclaimer, the term of this patent is extended or adjusted under 35 U.S.C. 154(b) by 164 days.

(21) Appl. No.: 15/418,326

(22) Filed: Jan. 27, 2017

(65) Prior Publication Data

US 2017/0218965 A1 Aug. 3, 2017

(30) Foreign Application Priority Data

Jan. 28, 2016 (EP) ..... 16153122

(51) Int. Cl.
*F04B 49/06* (2006.01)
*F04B 49/02* (2006.01)
(Continued)

(52) U.S. Cl.
CPC ..... *F04B 49/065* (2013.01); *F04B 41/02* (2013.01); *F04B 49/022* (2013.01); *F04C 28/06* (2013.01);
(Continued)

(58) Field of Classification Search
CPC ..... F04B 41/02; F04B 49/065; F04B 49/022; F04B 2203/0207; F04B 2203/0208;
(Continued)

(56) References Cited

U.S. PATENT DOCUMENTS 4,586,870 A * 5/1986 Hohlweg ..... F04D 27/0246 415/1
6,077,051 A 6/2000 Centers et al.
(Continued)

FOREIGN PATENT DOCUMENTS

CN 101144470 A 3/2008
CN 101514698 A 8/2009
(Continued)

OTHER PUBLICATIONS

Chinese Office Action dated Feb. 14, 2018; Chinese Application No. 2017100617310; ABB Technology Oy; 15 pgs. (including translation).
European Search Report, EP16153122, ABB Oy, dated Jul. 13, 2016, 8 pages.

*Primary Examiner* — Peter J Bertheaud
(74) *Attorney, Agent, or Firm* — Taft Stettinius & Hollister LLP; J. Bruce Schelkopf

(57) ABSTRACT

The present disclosure describes a load/unload control method for a compressor system with a rotating compressor connected to a pressure vessel. In the method, the present operating state can be monitored on the basis of a monitored/estimated electrical quantity of the compressor system. The method comprises an identification phase and an operational phase. In the identification phase, the compressor is operated at a constant rotational speed to generate two known pressures to the pressure vessel. At least one electrical quantity is monitored, and values of the electrical quantity corresponding to the pressure limits are stored. In the operational phase, reaching of a pressure limit may then be detected by comparing the present value of the monitored electrical quantity to the stored values.

15 Claims, 2 Drawing Sheets

(51) Int. Cl.

| | |
|---|---|
| ***F04B 41/02*** | (2006.01) |
| ***F04D 15/00*** | (2006.01) |
| ***F04C 28/08*** | (2006.01) |
| ***F04C 28/06*** | (2006.01) |
| ***F04D 27/00*** | (2006.01) |
| *F04C 28/28* | (2006.01) |
| *F04C 28/24* | (2006.01) |

(52) U.S. Cl.
CPC ..... *F04C 28/08* (2013.01); *F04D 15/0066* (2013.01); *F04D 15/0088* (2013.01); *F04D 27/004* (2013.01); *F04B 2203/0207* (2013.01); *F04B 2203/0208* (2013.01); *F04C 28/24* (2013.01); *F04C 28/28* (2013.01); *F04C 2240/40* (2013.01); *F04C 2270/015* (2013.01); *F04C 2270/025* (2013.01); *F04C 2270/035* (2013.01); *F04C 2270/075* (2013.01); *F04C 2270/095* (2013.01); *F04C 2270/185* (2013.01); *F04D 27/001* (2013.01)

(58) Field of Classification Search
CPC ..... F04C 28/06; F04C 28/08; F04D 15/0088; F04D 15/0066
See application file for complete search history.

(56) References Cited

U.S. PATENT DOCUMENTS

| | | | | |
|---|---|---|---|---|
| 6,918,307 | B2 * | 7/2005 | Ohlsson ..... | F04D 15/0088 415/17 |
| 2011/0129361 | A1 | 6/2011 | Sato | |
| 2011/0194963 | A1 | 8/2011 | Kawabata et al. | |

FOREIGN PATENT DOCUMENTS

| | | | |
|---|---|---|---|
| CN | 201535243 | U | 7/2010 |
| CN | 101901014 | A | 12/2010 |
| CN | 102086856 | A | 6/2011 |
| CN | 103527461 | A | 1/2014 |
| CN | 203742991 | U | 7/2014 |
| EP | 0750116 | A1 | 12/1996 |
| EP | 1670133 | A2 | 6/2006 |
| EP | 1906024 | A2 | 4/2008 |
| EP | 1670133 | A3 | 3/2009 |
| EP | 1906024 | A3 | 6/2012 |
| EP | 2565465 | A1 | 3/2013 |
| EP | 2565465 | A9 | 6/2013 |

* cited by examiner

LOAD/UNLOAD CONTROL METHOD FOR COMPRESSOR SYSTEM

FIELD OF THE INVENTION

The present invention relates to a load/unload control of a rotating compressor and particularly to estimating the operating state of the compressor.

BACKGROUND INFORMATION

A load/unload control scheme may be used to control a large variety of applications. A load/unload control is well suited for arrangements where a compressor is connected to a large pressure vessel, for example. Under the load/unload control scheme, a compressor operated at a constant speed is controlled to a load mode or an unload mode in turn.

In the load mode, the compressor generates mass flow, thus increasing the pressure in the pressure vessel. When the pressure in the pressure vessel reaches a set maximum limit, the compressor is set to the unload mode.

In the unload mode, the compressor still runs, but generates does not generate mass flow. Various strategies may be used for unloading a compressor. For example, a compressor may be controlled to a load mode or an unload mode by controlling an inlet valve of the compressor. As no mass flow is generated, the pressure in the pressure vessel starts to decrease. In the unload mode, the compressor may only use a fraction of the power consumption during the load mode. The rate of decrease may depend on the output demand. When the pressure drops to a set minimum level, the load mode is reactivated.

In order to determine when to switch to the load mode or to the unload mode, the compressor system may comprise a pressure sensor or a sensor for detecting when a limit has been reached. Such sensors may increase the cost of the compressor system. Further, the sensors may be prone to malfunctions and may require regular maintenance.

BRIEF DISCLOSURE

An object of the present invention is to provide a method and an apparatus for implementing the method so as to alleviate the above disadvantages. The objects of the invention are achieved by a method and an arrangement which are characterized by what is stated in the independent claims. The preferred embodiments of the invention are disclosed in the dependent claims.

The present disclosure describes a load/unload control method for a compressor system with a rotating compressor connected to a pressure vessel. In the method, the present operating state (e.g. the pressure in a pressure vessel) can be monitored on the basis of a monitored/estimated electrical quantity of the compressor system. The method comprises an identification phase and an operational phase.

In the identification phase, the compressor is operated at a constant rotational speed to generate two known pressures (i.e. the minimum limit and the maximum limit) to the pressure vessel. At least one electrical quantity (e.g. mechanical power or torque of a motor powering the compressor) is monitored, and values of the electrical quantity corresponding to the pressure limits are stored.

In the operational phase, reaching of a pressure limit may then be detected by comparing the present value of the monitored electrical quantity to the stored values.

In this manner, the compressor system can be operated without pressure sensors.

BRIEF DESCRIPTION OF THE DRAWINGS

In the following the invention will be described in greater detail by means of preferred embodiments with reference to the attached drawings, in which.

DETAILED DISCLOSURE

The present disclosure presents a load/unload control method for a compressor system that comprises a compressor connected to a pressure vessel, a frequency converter controlling an electric motor of the compressor, and means for setting the compressor to either a load mode or an unload mode. The compressor may be a positive displacement compressor (e.g. a screw compressor) or a dynamic compressor (e.g. a centrifugal compressor). During the normal operation of the load/unload control method according to the present disclosure, the control goal may be to maintain an average pressure inside the pressure vessel at a desired level. In order to achieve this, the compressor may be operated at a constant speed and controlled to the load mode or the unload mode so that the pressure inside the pressure vessel remains within set bounds. These bounds may in the form of a minimum (lower) pressure limit and a maximum (upper) pressure limit. The constant rotational speed may be a nominal speed of the compressor, for example.

Figure 1:
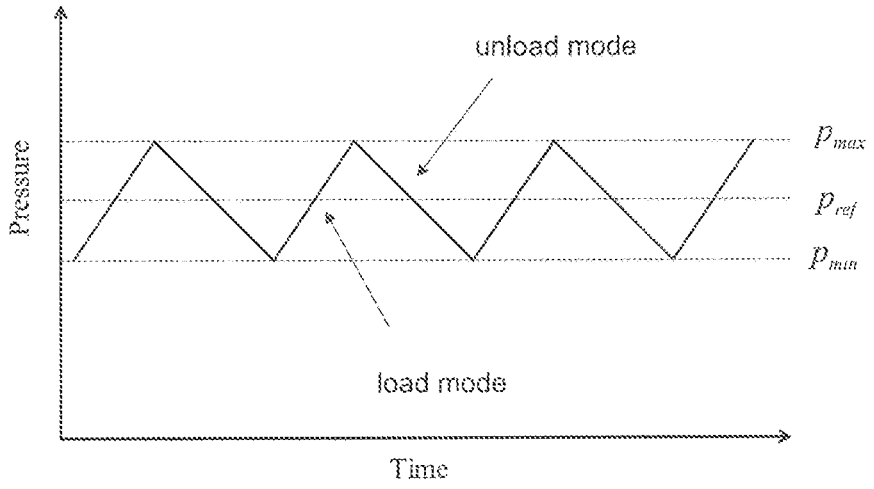
FIG. 1 shows a simplified example of operation of an exemplary compressor system.

FIG. 1 shows a simplified example of operation of an exemplary compressor system. In FIG. 1, the pressure in a pressure vessel of the compressor system is shown as a function of time during an operational phase of the compressor. The function shows the compressor in the load mode and in the unload mode. In the load mode, the compressor generates mass flow, thus increasing the pressure in the pressure vessel. When the pressure in the pressure vessel has reached a set maximum (upper) limit $p_{max}$, the compressor is set to the unload mode. In the unload mode, the compressor still runs, but does not generate mass flow. As a result, the pressure in the pressure vessel starts to decrease. The rate of decrease may depend on the output demand. When the pressure drops to a set minimum level $p_{min}$, the load mode is activated again. In this manner, the average pressure inside the pressure can be maintained at a desired level $p_{ref}$.

In a method according to the present disclosure, the present operating state (e.g. the pressure in a pressure vessel) can be monitored on the basis of at least one monitored/estimated electrical quantity of the compressor system. The monitored electrical quantity may be an electrical quantity proportional to the pressure in the pressure vessel at a constant rotational speed. In this manner, each value of the quantity can be used to represent a certain pressure. The monitored electrical quantity may be a mechanical power or torque of the motor powering the compressor, for example.

In order to determine the exact relation between the monitored electrical quantity and the pressure in a compressor system, the method according to the present disclosure comprises an identification phase before an operational phase. The identification phase comprises an identification run, during which the pressure vessel is pressurized. The compressor may operate at a known rotational speed of the electric motor to increase pressure inside the pressure vessel while monitoring the pressure and at least one electrical quantity of the compressor system.

Based on the monitored pressure and the at least one electrical quantity, a first level for the at least one electrical quantity may be determined. The first value may represent a first pressure limit of the pressure inside the pressure vessel. The first level may represent the minimum pressure limit in the unload mode of the load/unload control method, for example. Further, a second level for the at least one electrical quantity may be determined on the basis of the monitored pressure and the at least one electrical quantity. The second level may represent a second pressure limit of the pressure inside the pressure vessel. The second level may represent the maximum pressure limit in the load mode of the load/unload control method, for example. Operating the compressor during the identification phase may comprise operating the compressor in the load mode to pressurise the pressure vessel and operating the compressor in the unload mode to depressurise the pressure vessel. The pressure and at least one electrical quantity of the compressor system may be monitored during the pressurization and depressurization.

The frequency converter may be utilized for monitoring electrical quantities. For example, measurements of the voltages and currents of the motor may be available from the frequency converter. Based on the voltages and currents, an estimate of the mechanical power of the compressor may be calculated. At a constant rotational speed, the mechanical power is proportional to the pressure inside the pressure vessel. Thus, the mechanical power may be used for representing the pressure. In a frequency converter controlled with a Direct Torque Control (DTC) scheme, an estimate of the produced torque may be directly available from the frequency converter control system. At a constant rotational speed, an estimate of the torque of the electric motor may be used for representing the pressure inside the pressure vessel. The frequency converter may store samples of the electrical quantity/quantities with time stamps into its memory, for example.

The pressure may be monitored by using various approaches. In some embodiments, temporary or permanent pressure sensors may be used during the identification phase. In one embodiment of the method according to the present disclosure, the pressure in the pressure vessel may be monitored during the identification phase by using a pressure sensor which provides continuous pressure information to the frequency converter, for example. The first and second level may be directly determined on the basis of the available information. In other words, the first and second level may be directly set to values of the monitored electrical quantity corresponding to the first pressure limit and the second pressure limit. In another embodiment, the frequency converter may be provided only with time instant information indicating when a predetermined pressure limit has been reached. In this manner, the value of the monitored electrical quantity during the time instant of reaching the predetermined pressure limit can be associated with the predetermined pressure limit. If the predetermined pressure limit coincides with the first pressure limit or the second pressure limit of the load/unload control, the value of the monitored electrical quantity may be directly used as the first or the second level.

Alternatively, in the case of the predetermined pressure limits not coinciding with the first and the second pressure limit of the load/unload control, the first and second level may be calculated from interpolation functions which are based on the predetermined pressure limits and the values of the monitored electrical quantity corresponding to the detected pressure limits. An interpolation function may be calculated for both the load mode and the unload mode.

For example, the second level (which may be used to activate the load mode) may be determined when the compressor operates in the load mode by detecting a first known pressure inside the pressure vessel and a first value of the at least one electrical quantity corresponding to the first known pressure, and by detecting a second known pressure inside the pressure vessel and a second value of the at least one electrical quantity corresponding with the second known pressure. On the basis of the first and second known pressure and the first and second value, an interpolation function may be formed. The interpolation function may represent a relation between the pressure inside the pressure vessel and the monitored at least one electrical quantity. For example, if the mechanical power of the compressor is the monitored electrical quantity, the interpolation function may represent the pressure as a function of the mechanical power. In the case of a positive displacement compressor, for example, the interpolation function may be a linear function passing through two pressure-power points defined by two detected pressure limits and their corresponding values of monitored mechanical power. The second level may then be determined on the basis of the interpolation function and the second pressure limit.

Figure 2:
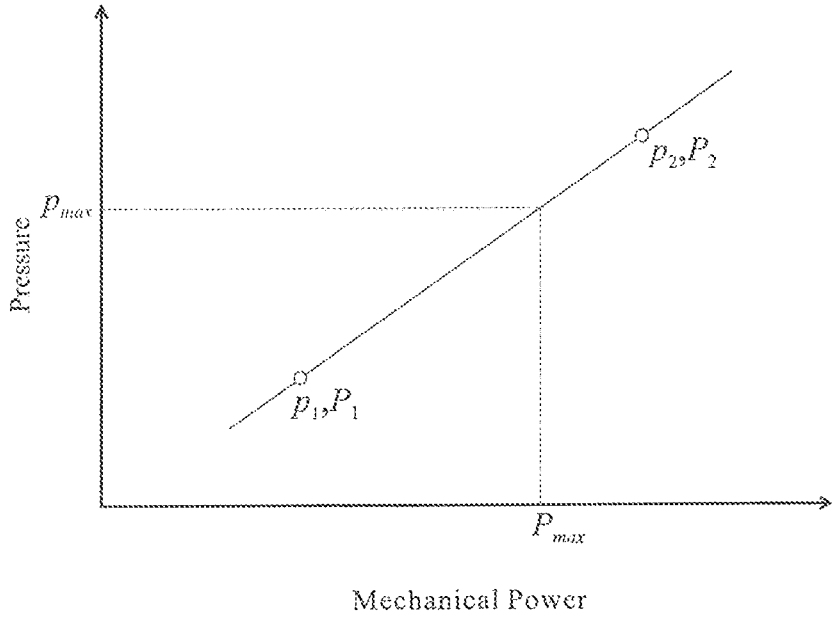
FIG. 2 shows a simplified example of an interpolation function.

FIG. 2 shows a simplified example of an interpolation function. In FIG. 2, the interpolation function represents the pressure in the load mode as a function of the mechanical power. The function is a linear curve that passes through two points which are defined by two detected pressure limits $p_1$ and $p_2$ and their corresponding values $P_1$ and $P_2$ of the mechanical power. Based on the function, a second level $P_{max}$ for the monitored mechanical power predetermined can easily be determined for a desired second pressure level $p_{max}$, of the load/unload control.

In a similar manner, the first level (used to activate the unload mode) may be determined in the unload mode by detecting a first known pressure inside the pressure vessel and a first value of the at least one electrical quantity corresponding to the first known pressure, and by detecting a second known pressure inside the pressure vessel and a second value of the at least one electrical quantity corresponding to the second known pressure. Similarly is to the second level, an interpolation function may be formed on the basis of the first and second known pressure and the first and second value. The first level may then be determined on the basis of the interpolation function and the first pressure limit, for example, in a manner as shown in FIG. 2.

In yet another embodiment, where the compressor system comprises a minimum pressure valve with a known pressure limit and/or a maximum pressure valve with a known pressure limit, a pressure valve may be utilized in determining the present pressure in the pressure vessel. During the load mode and the unload mode of the identification run, time-stamped samples of the monitored electrical quantity may be stored. Based on the stored samples, the monitored electrical quantity may be represented as a function of time. Time instants of activation/deactivation of the pressure valve may then be determined by observing a distinct change in the slope (i.e. rate of change) of the function. The value of the electrical quantity in the function at the determined time instant may then be paired with the pressure limit of the valve.

Figure 3:
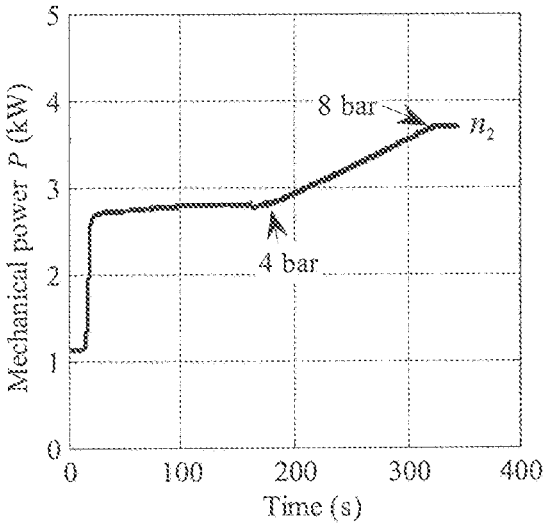
FIG. 3 shows an exemplary identification run at a constant rotational speed.

FIG. 3 shows an exemplary identification run at a constant rotational speed. In FIG. 3, the mechanical power of the compressor in a load mode is shown as a function of time. A minimum pressure valve closed at 4 bar, and a maximum pressure valve opened at 8 bar. The function shows a distinct change in the slope of the curve both when the minimum pressure valve deactivated and when the maximum pressure valve activated. The first 60 seconds of measurements were reserved for starting the compressor and ensuring that the compressor unit works at a constant rotational speed and provides constant pressure into the surrounding system. However, depending on the compressor unit, the start-up time may also be shorter or longer.

Again, if the pressure limits of the pressure valves coincide with the first pressure limit and/or the second pressure limit, the value of the monitored electrical quantity may be directly used as the first and/or the second level. Alternatively, as described above, the first and/or second level may be calculated from interpolation functions which are based on the limits of the pressure valves and the values of the monitored electrical quantity corresponding to the pressure limits.

In yet another embodiment, a known mechanical power at a nominal pressure of the compressor may be utilized in determining the first and the second level. Information on known mechanical power at a nominal pressure may be available in compressor/pump characteristics provided by the manufacturer, for example. With this information a pressure-power point can be formed. Further, in some embodiments, another pressure-power point may be determined on the basis of the mechanical power at the atmospheric pressure (e.g. when the pressure vessel is empty).

When the identification phase has been finished and the first level and the second level for the at least one monitored electrical quantity have been determined, the operational mode may be initiated. In the operational phase, the load/unload control scheme is started. The compressor may be operated at the known rotational speed, and the present value of the at least one electrical quantity may be monitored. If the present value falls to the first level, the compressor may be set to the load mode. If the present value rises to the second level, the compressor may be set to the unload mode. If the pressure keeps on rising even when the compressor is in the unload mode, the compressor may be shut down.

The present disclosure also describes a device for implementing a method according to the present disclosure. The method may be implemented on an apparatus comprising a computing device, such as a processor, an FPGA (Field-programmable gate array) or an ASIC (Application Specific Integrated Circuit) and a memory, for example. The method can be implemented on a frequency converter controlling the electric motor of the compressor, for example. This may be desirable when estimates/measurements of the monitored electrical quantities are readily available from the frequency converter.

It will be obvious to a person skilled in the art that the inventive concept can be implemented in various ways. The invention and its embodiments are not limited to the examples described above but may vary within the scope of the claims.

The invention claimed is:

1. A load/unload control method for a compressor system comprising a compressor connected to a pressure vessel, a frequency converter controlling an electric motor of the compressor, and means for setting the compressor to either a load mode or an unload mode, wherein the method comprises an identification phase and an operational phase, and wherein the identification phase comprises:

operating the compressor at a known rotational speed of the electric motor to increase pressure inside the pressure vessel while monitoring the pressure and at least one electrical quantity of the compressor system, determining a first level for the at least one electrical quantity on the basis of the monitored pressure and the at least one electrical quantity, wherein the first level represents a first pressure limit of the pressure inside the pressure vessel, determining a second level for the at least one electrical quantity on the basis of the monitored pressure and the at least one electrical quantity, wherein the second level represents a second pressure limit of the pressure inside the pressure vessel, and storing the first level and the second level, and wherein the operational phase comprises:

operating the compressor al the known rotational speed, monitoring a present value of the at least one electrical quantity, and if the present value falls to the first level, setting the compressor to the load mode or, if the present value rises to the second level, setting the compressor to the unload mode.

2. A method according to claim 1, wherein the monitored electrical quantity is measured or estimated by using the frequency converter.

3. A method according to claim 2, wherein the monitored electrical quantity is a mechanical power or torque of the electric motor.

4. A method according to any one of claim 1, wherein the operating of the compressor during the identification phase comprises:

operating the compressor in the load mode to pressurize the pressure vessel in order to determine the second level, and operating the compressor n the unload mode to depressurize the pressure vessel in order to determine the first level.

5. A method according to claim 4, wherein the determining of the second level is performed when the compressor operates in the load mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the second level on the basis the interpolation function and the second pressure limit.

6. A method according to claim 4, wherein the determining of the first level is performed when the compressor operates in the unload mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

7. A method according to any one of claim 2, wherein the operating of the compressor during the identification phase comprises:

operating the compressor in the load mode to pressurize the pressure vessel in order to determine the second level, and operating the compressor in the unload mode to depressurize the pressure vessel in order to determine the first level.

8. A method according to any one of claim 3, wherein the operating of the compressor during the identification phase comprises:

operating the compressor in the load mode to pressurize the pressure vessel in order to determine the second level, and operating the compressor in the unload mode to depressurize the pressure vessel in order to determine the first level.

9. A method according to claim 7, wherein the determining of the second level is performed when the compressor operates in the load mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the second level on the basis the interpolation function and the second pressure limit.

10. A method according to claim 8, wherein the determining of the second level is performed when the compressor operates in the load mode and comprises detecting a first known pressure inside the pressure vessel and a first value of the at least one electrical quantity corresponding to the first known pressure, detecting a second known pressure inside the pressure vessel and a second value of the at least one electrical quantity correspond ng to the second known pressure, forming an interpolation function n the basis the first and second known pressure and the first and second value, wherein the interpolation function represents a relation between the pressure inside the pressure vessel and the monitored at least one electrical quantity, and determining the second level on the basis the interpolation function and the second pressure limit.

11. A method according to claim 5, wherein the determining of the first level is performed when the compressor operates in the unload mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

12. A method according to claim 7, wherein the determining of the first level is performed when the compressor operates in the unload mode and comprises detecting, a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

13. A method according to claim 8, wherein the determining of the first level is performed when the compressor operates in the unload mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

14. A method according to claim 9, wherein the determining of the first level is performed when the compressor operates in the unload mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

15. A method according to claim 10, wherein the determining of the first level is performed when the compressor operates in the unload mode and comprises detecting a first known pressure inside the pressure vessel and a first value of the at least one electrical quantity corresponding to the first known pressure, detecting a second known pressure inside the pressure vessel and a second value of the at least one electrical quantity corresponding to the second known pressure, forming an interpolation function on the basis the first and second known pressure and the first and second value, wherein the interpolation function represents a relation between the pressure inside the pressure vessel and the monitored at least one electrical quantity, and determining the first level on the basis the interpolation function and the first pressure limit.

* * * * *